US005504566A

United States Patent [19]

Chow et al.

[11] Patent Number: 5,504,566

[45] Date of Patent: Apr. 2, 1996

[54] DUAL METERING BLADE FOR FUSING COLOR TONER IMAGES

[75] Inventors: Che C. Chow, Penfield; Anthony S. Condello, Webster; Robert M. Jacobs, Ontario; Alvin D. Kromm, Jr., Webster; Rabin Moser, Victor, all of N.Y.

[73] Assignee: Xerox Corporation, Stamford, Conn.

[21] Appl. No.: 435,917

[22] Filed: May 5, 1995

[51] Int. Cl.[6] ..... G03G 15/20

[52] U.S. Cl. ..... 355/284; 118/60; 219/216

[58] Field of Search ..... 355/284; 219/216; 432/59, 60; 118/60, 261, 264, 268, 270

[56] References Cited

U.S. PATENT DOCUMENTS 4,214,549 7/1980 Moser ..... 118/60

4,254,732 3/1981 Moser ..... 118/60

5,200,786 4/1993 Fromm et al. ..... 355/284

OTHER PUBLICATIONS

Xerox Disclosure Journal, vol. 3, No. 6, Nov./Dec. 1978.

*Primary Examiner*—Joan H. Pendegrass

[57] ABSTRACT

An apparatus for fusing toner images to a substrate. A Release Agent Management (RAM) system for applying silicone oil to a metering roll utilizes a pair of metering blades to improve oil uniformity on the metering roll. Thus, streaks or localized areas of excess silicone oil as the result of blade defects and/or dirt accumulation associated with a first blade, ARE metered or smoothed to a more uniform thickness by the second blade. To this end, the first metering blade serves to meter silicone oil to a first predetermined thickness while the second blade serves to meter oil streaks to a second predetermined thickness which is greater than the first predetermined thickness.

20 Claims, 2 Drawing Sheets

DUAL METERING BLADE FOR FUSING COLOR TONER IMAGES

BACKGROUND OF THE INVENTION

This invention relates generally to electrophotographic printing and more particularly it relates to an image treatment method and apparatus for fusing toner images, with special emphasis on a Release Agent Management (RAM) system therefor.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the color toner material occurs causing the toner material to be bonded firmly to the support member. One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer, for example, tetrafluoroethylene resin sold by E. I. DuPont De Nemours under the trademark Teflon. To further enhance release, a release agent material such as silicone oil is applied to elastomer coating.

A RAM system comprising a metering roll and a donor roll has been utilized effectively in commercial imaging apparatuses. With such a system, it is customary to use a metering blade to meter the silicone oil or other suitable release agent material to a desired thickness onto a metering roll. In the fusing of monochrome (i.e. black on a conventional imaging substrate) the uniformity of the oil layer on the metering roll is not so critical compared to that required for color toner images, particularly, those associated with transparency substrate materials used for optically projecting the color images. The silicone oil is metered onto the roll using one or more metering blades.

The use of a metering blade that is contaminated with dirt or which has defects can result in the release agent oil being nonuniformly metered onto the metering roll. Such nonuniform application of oil can change the gloss characteristics of the color images and/or adversely affect the projection of color toner images carried by a transparency by creating streaks.

Following is a discussion of prior art, incorporated herein by reference, which may bear on the patentability of the present invention. In addition to possibly having some relevance to the patentability, these references, together with the detailed description to follow, may provide a better understanding and appreciation of the present invention.

One method of applying a release agent such as silicone oil utilizes a combination donor/metering roll arrangement wherein the metering roll contacts silicone oil in a sump and conveys a non metered amount to the metering blade. The metered layer of oil on the metering roll is transported to the donor roll and subsequently to a heated fuser roll. One such Release Agent Metering (RAM) system for applying silicone oils to a heated fuser roll is illustrated in U.S. Pat. No. 4,214,549. The system disclosed therein comprises a donor roll fabricated from a heat insulative and deformable material, for example, silicone rubber which transfers functional release material from a metering roll contacting a supply of release material contained in a sump to the heated fuser roll. A metering blade is supported in contact with the metering roll for metering the release material onto the metering roll to a specified amount per copy. This type of RAM system dispenses a fixed amount of release agent material to the fuser roll member.

In U.S. Pat. No. 5,200,786 granted to Fromm et al on Apr. 6, 1993, the donor roll of the '549 patent is replaced with a donor brush. As set forth in the '786 patent, the brush donor structure allows for the application of variable amounts of release agent material depending on the mode of operation. In other words, when color prints are being created a greater quantity of silicone oil is applied to the fuser roll compared to the amount applied when operating in the monochrome black mode.

A release agent management system is disclosed in Xerox disclosure Journal, Vol. 3, Number 6, November/December 1978. As disclosed therein, the RAM system comprises a metering roll to which silicone oil is applied or metered using a pair of blades. The metering roll is disposed such that it can be rotated through silicone oil contained in a sump. A first metering blade is supported for contact with the roll in a position below a second metering blade. The first metering blade is mounted slightly above the fluid level of the silicone oil contained in the sump. By tandem mounting the two blades less frequent maintenance is required because there is double the area for toner or dirt accumulation. By such orientation of these blades, the device is less dependent upon a tall curtain of oil, thus allowing a minimum static height which minimizes potential sloshing problems when the machine containing the device is moved about. The blade serves to pre-meter a fixed amount of oil which can subsequently be precision metered to the roll by the second blade. Thus, a first thickness of oil is metered to a lesser thickness by the second blade.

BRIEF SUMMARY OF THE INVENTION

An apparatus for fusing color toner images to a substrate comprises a Release Agent Management (RAM) system for applying silicone oil to a metering roll. The RAM utilizes a pair of metering blades to improve oil metering on the metering roll. Silicone oil streaks or localized oil deposits, due to blade defects and/or dirt accumulation associated with a first blade, are metered to an acceptable thickness by a second blade thereby eliminating undesirable consequences of such streaks on the final copy quality. Each blade is designed to meter an amount of oil to a predetermined thickness, for example, in the order of 4 to 5 micro liters per copy by the first blade and 8 to 10 micro liters per copy by the second blade. Any streaks or localized areas of silicone oil on the metering roll after the metering action of the first metering blade effectively metered by the second blade thereby eliminating streaks. Thus, in accordance with the invention, each of the metering blades serves to meter silicone oil to different thickness, the purpose of the second metering blade being to smooth oil streaks or accumulated oil on certain areas of the metering roll as well as filling voids with oil.

DETAILED DESCRIPTION OF THE PREFERRED EMBODIMENT(S) OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
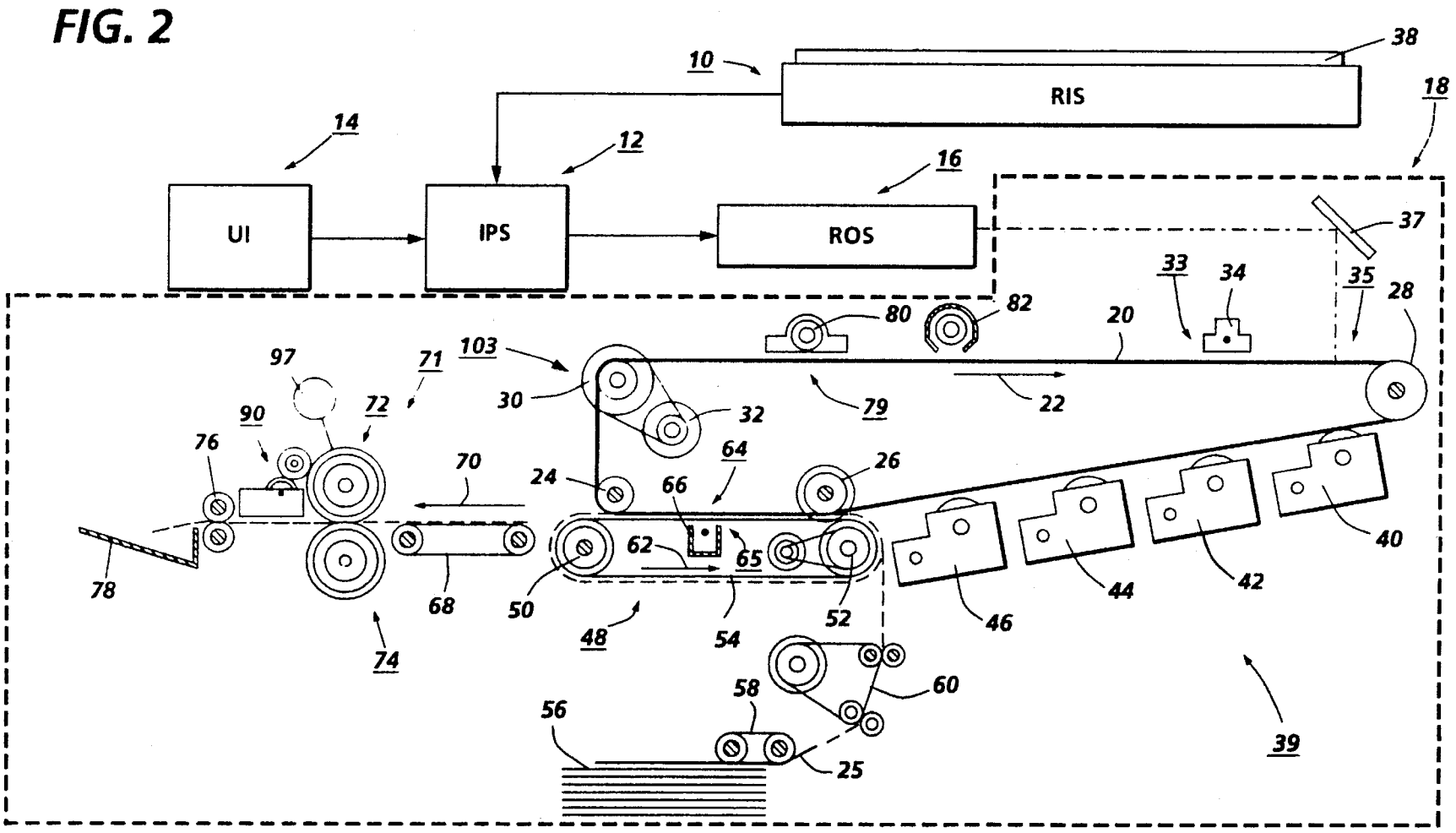
FIG. 2 is a schematic illustration of a imaging apparatus incorporating the invention.

For a general understanding of the features of the present invention, reference is made to the drawings. FIG. 2 schematically depicts the various components of an illustrative electrophotographic printing machine incorporating the present invention therein. It will become evident from the following discussion that the apparatus of the present invention is equally well suited for use in a wide variety of printing machines, and is not necessarily limited in its application to the particular electrophotographic printing machine shown herein.

Turning initially to FIG. 2, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. U114 enables an operator to control the various operator adjustable functions. The output signal from U1 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer including a marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multicolored image on the copy sheet. This multi-colored image is then fused to the copy sheet forming a color copy. Alternatively, the superimposed images may be deposited on a transparent substrate of the type utilized for the optical projection of images.

With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various xerographic processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive, not shown. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing toner particles onto the electrostatic latent image recorded on photoconductive belt 20. Similarly, a blue separation is developed by developer unit 42 with blue absorbing toner particles, while the red separation is developed by developer unit 44 with red absorbing toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 2, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet.

The fusing station includes a heated fuser roll 72 and a pressure roll 74. The sheet passes through the nip defined by fuser roll 72 and pressure roll 74. The toner image contacts fuser roll 72 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 1:
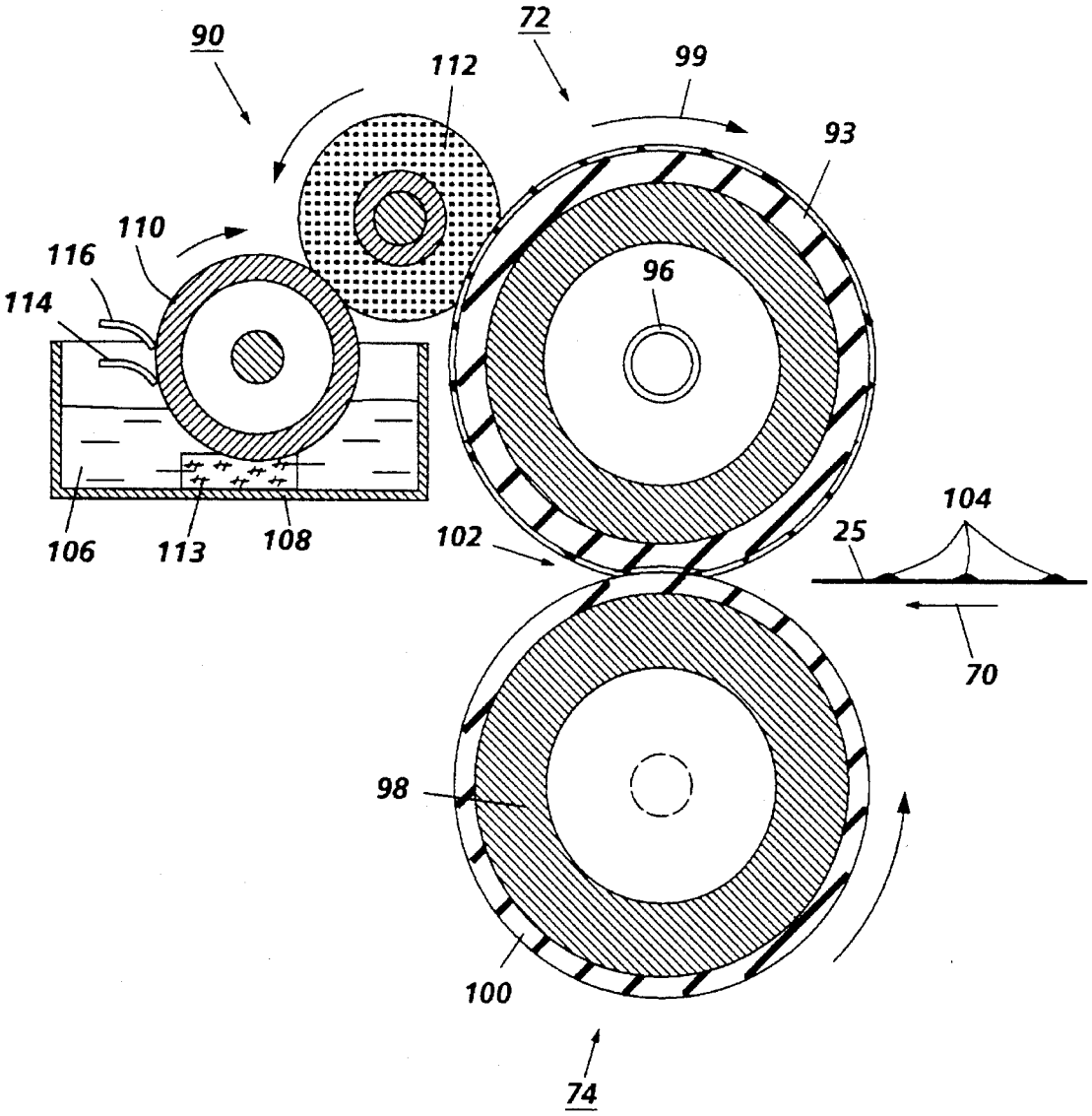
FIG. 1 is a schematic illustration of a color toner fusing apparatus according to the invention.

Attention is now directed to FIG. 1 wherein the heat and pressure fuser apparatus comprising the fuser roll 72 and pressure roll 74 are illustrated together with a release agent management (RAM) system 90. As shown in FIG. 1, the fuser apparatus comprises the heated fuser roll 72 which is composed of a core 92 having thereon a relatively thick layer 93 of thermally conductive silicone rubber over coated with a relatively thin layer 94 of Viton a registered trademark of E.I. dupont Co. The core 92 may be made of various metals such as copper, iron, aluminum, nickel, stainless steel, etc. Aluminum is preferred as the material for the core 92, although this is not critical. The core 92 is hollow and a heating element 96 is generally positioned inside the hollow core to supply the heat for the fusing operation. Heating elements suitable for this purpose are known in the prior art and may comprise a quartz infrared heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The fusing elastomer layer may be made of any of the well known materials such as the Viton and/or silicone rubber. The fuser roll 72 is adapted, using a motor 97, to be rotated in the direction of the arrow 99.

The fuser roll 72 is shown in a pressure contact arrangement with the backup or pressure roll 74. The pressure roll 74 comprises a metal core 98 with an outer layer 100 of a heat-resistant material. In this assembly, both the fuser roll 72 and the pressure roll 74 are mounted on bearings (not shown) which are mechanically biased so that the fuser roll 72 and pressure roll 74 are pressed against each other under sufficient pressure to form a nip 102. It is in this nip that the fusing or fixing action takes place. The layer 100 may be made of any of the well known materials such as Teflon a trademark of E.I. dupont.

The image receiving member or final support 25 having toner images 104 thereon is moved through the nip 102 with the toner images contacting the heated fuser roll 72. The toner material forming the image 104 is prevented from offsetting to the surface of the fuser roll 72 through the application of a release agent material such as silicone oil 106 contained in sump 108.

The sump 108 and silicone oil 106 form part of the RAM system 90. The RAM system 90 further comprises a metering roll 110 and a donor roll 112. The metering roll is supported partially immersed in the silicone oil 106 and contacts the donor roll for conveying silicone oil from the sump to the surface of the donor roll 112. The metering roll also contacts a pad 113 which is immersed in the silicone oil. The pad or wick serves to provide an air seal which disturbs the air layer formed at the surface of the metering roll during rotation thereof. In the absence of the pad, the air layer would be coextensive with the surface of the metering roll thereby precluding contact between the metering roll and the release agent.

The donor roll is rotatably supported in contact with the metering roll and also in contact with the fuser roll 72. Rotation of the donor roll is effected through frictional engagement with the fuser roll 72 and rotational movement of the metering roll 110 is effected through engagement with the donor roll 112. While the donor roll is illustrated as contacting the fuser roll, it will be appreciated that, alternately, it may contact the pressure roll 74. Also, the positions of the fuser and pressure rolls may be reversed for use in other copiers or printers. A pair of metering blades 114 and 116 supported in contact with the metering roll 110 serve to meter silicone oil to the required thickness on the metering roll.

The metering blades 114 and 116 function in a docktoring fashion to meter the silicone oil onto the surface of the fuser roll. The blade members are fabricated from an elastomeric material such as Viton in accordance with well known manufacturing techniques. The blades 114 and 116 are supported for pressure engagement with the surface of the metering roll such that they meter silicone oil to different thicknesses.

The first metering blade 114 is adapted to meter the thickness of the silicone oil on the metering roll to approximately 4 to 5 micro liters per copy while the second metering blade 116 is adapted to meter silicone oil to a thickness of approximately 8 to 10 micro liters per copy. The second metering blade is adapted to meter the same amount of oil or less oil than the first metering blade in order to prevent or avoid accumulation of silicone oil at the tip of the second blade 116. When there are streaks or localized areas of oil on the metering roll which exceed 8 to 10 micro liters per copy, due to imperfections caused by dirt accumulation on the first blade, the second blade assures metering these localised streaks to 10 micro liters per copy or less thus preventing visible streaks on the copies.

As an example, let's say that following the metering by the first blade 114, that there are localized deposits or streaks of oil on the metering roll which are about 15 micro liters per copy thick. In this situation, the second metering blade functions to meter the localized deposits or streaks of oil on the metering roll from 15 to about 8–10 micro liters per copy. This function of the second metering blade can be effected via well known blade loading techniques as well as blade durometer, metering blade tip or radius design or a combination of the foregoing. Thus, in order to effect metering to different thicknesses, the two blades 114 and 116 can have different durometers or have different loads for effecting engagement of the blade tips with the metering roll. Also, for this purpose, the blades may be provided with a different tip configuration.

When there are no streaks of oil on the metering roll then the thickness of the silicone oil on the metering roll would be equal to 4 to 6 micro liters per copy. Thus, the second metering blade would not effect any metering under such conditions.

What is claimed is:

1. A method of metering release agent material onto a metering member, said method including the steps of:

immersing part of a metering member in a supply of release agent material contained in a sump;

disrupting an air layer on a surface of said metering member disposed in said release agent whereby release agent material contacts said surface for being conveyed thereby;

moving said metering member whereby a quantity of release agent material is removed from said sump;

contacting said metering member with a first blade member for metering release agent material on said metering member to a first predetermined thickness; and contacting said metering member with a second metering blade for metering streaks of release agent material to a second predetermined thickness, said second predetermined thickness being greater than said first predetermined thickness and less than the thickness of said streaks.

2. The method according to claim 1 wherein said step of disrupting an air layer comprises contacting said metering member with a pad disposed in said release agent material.

3. The method according to claim 2 wherein said metering member comprises a roll.

4. The method according to claim 3 wherein said release agent material comprises silicone oil.

5. The method according to claim 1 wherein said first predetermined thickness is approximately 5 micro liters per copy.

6. The method according to claim 5 wherein said second predetermined thickness is about 9 micro liters per copy.

7. The method according to claim 6 wherein said thickness of said streaks is larger than 10 micro liters per copy.

8. The method according to claim 7 wherein said blades are fabricated from Viton.

9. The method according to claim 7 wherein said blades have a different durometer for enabling metering to said first and second predetermined thicknesses.

10. The method according to claim 9 wherein said blades have a different tip configuration for enabling metering to said first and second predetermined thicknesses.

11. Apparatus for metering release agent material onto a metering member, said apparatus comprising:

a metering member immersed in a supply of release agent material contained in a sump;

means for disrupting an air layer on a surface of said metering member disposed in said release agent whereby release agent material contacts said surface for being conveyed thereby;

means for moving said metering member whereby a quantity of release agent material is removed from said sump;

a first blade member contacting said metering member for metering release agent material on said metering member to a first predetermined thickness;

a second metering blade contacting said metering member for metering streaks of release agent material to a second predetermined thickness, said second predetermined thickness being greater than said first predetermined thickness and less than the thickness of said streaks.

12. Apparatus according to claim 11 wherein means for disrupting an air layer comprises a pad disposed in said release agent material and contacting said metering roll.

13. Apparatus according to claim 12 wherein said metering member comprises a roll.

14. Apparatus according to claim 13 wherein said release agent material comprises silicone oil.

15. Apparatus according to claim 13 wherein said first predetermined thickness is approximately 5 micro liters per copy.

16. Apparatus according to claim 15 wherein said second predetermined thickness is about 9 micro liters per copy.

17. Apparatus according to claim 16 wherein said thickness of said streaks is less than 10 micro liters per copy.

18. Apparatus according to claim 17 wherein said blades are fabricated from silicone Viton.

19. Apparatus according to claim 18 wherein said blades have a different durometer for enabling metering to said first and second predetermined thicknesses.

20. Apparatus according to claim 18 wherein said blades have a different tip configuration for enabling metering to said first and second predetermined thicknesses.

* * * * *